United States Patent [19]

Zoland

[11] 4,142,564

[45] Mar. 6, 1979

[54] COLLAPSIBLE BAG WITH EXPANDABLE BAG INSERT

[76] Inventor: Martin Zoland, 76 Raglan St., Preston, Melbourne, Australia, 3072

[21] Appl. No.: 857,081

[22] Filed: Dec. 5, 1977

[51] Int. Cl.[2] ..... A45C 7/00

[52] U.S. Cl. ..... 150/31; 190/43

[58] Field of Search ..... 150/28 R, 31, 35, 1; 190/43, 44, 42, 50, 49

[56] References Cited

U.S. PATENT DOCUMENTS

| | | | |
|---|---|---|---|
| 1,051,716 | 1/1913 | Eiseman | 150/31 |
| 2,798,579 | 7/1957 | Fox | 190/43 |

*Primary Examiner*—Donald F. Norton

*Attorney, Agent, or Firm*—Ostrolenk, Faber, Gerb & Soffen

[57] ABSTRACT

A collapsible bag and an expandable insert located therein said insert comprising a pair of generally parallel plate members and a tongue, the tongue being rotatably mounted between the plate members for rotation between a first position wherein the tongue lies generally parallel to the plate members and a second position wherein the tongue is transverse to the plate members, and a pull member accessible from the exterior of the bag which is operable to cause movement of the tongue from its first to its second position thereby causing the tongue to separate said plate members and expand the bag.

9 Claims, 6 Drawing Figures

COLLAPSIBLE BAG WITH EXPANDABLE BAG INSERT

This invention relates to an apparatus for permitting shipment of flexible sided bags such as cosmetic bags, purses, soft-sided luggage and handbags in a flattened condition with means provided within the bag by which the bag may be expanded to present an attractive appearance at the point of sale. In shipping of merchandise, freight payments are made, not only with respect to weight, but also with respect to volume. By providing a device which may be inserted in the bag at the point of manufacture, and may be expanded at the point of display by merely pulling a string, the bag may be shipped flat and erected for a suitable attractive appearance at the point of sale.

According to the present invention there is provided a collapsible bag and an expandable insert located therein, said insert comprising a pair of generally coplanar plate members and a tongue, said tongue being rotatably mounted between the plate members for rotation between a first position wherein the tongue lies generally in the same plane as the plate members and a second position wherein the tongue is transverse to the plate members, an operating means accessible from the exterior of the bag which means is operable to cause movement of the tongue from its first to its second position thereby causing the tongue to separate said plate members relative to one another and thereby expand the bag.

The invention will now be further described with reference to the accompanying drawings in which.

Figure 1:
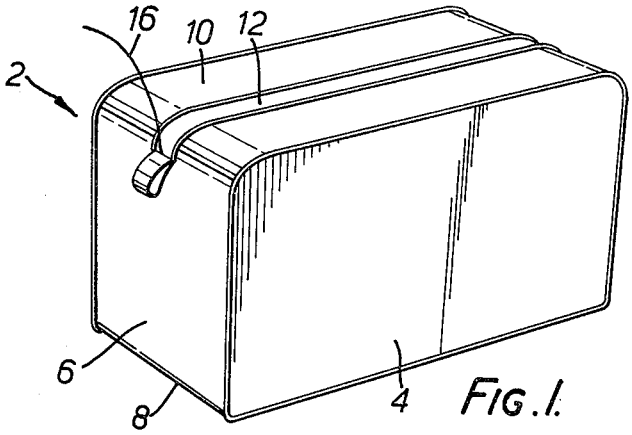
FIG. 1 is a perspective view of a collapsible bag embodying the invention.
Figure 2:
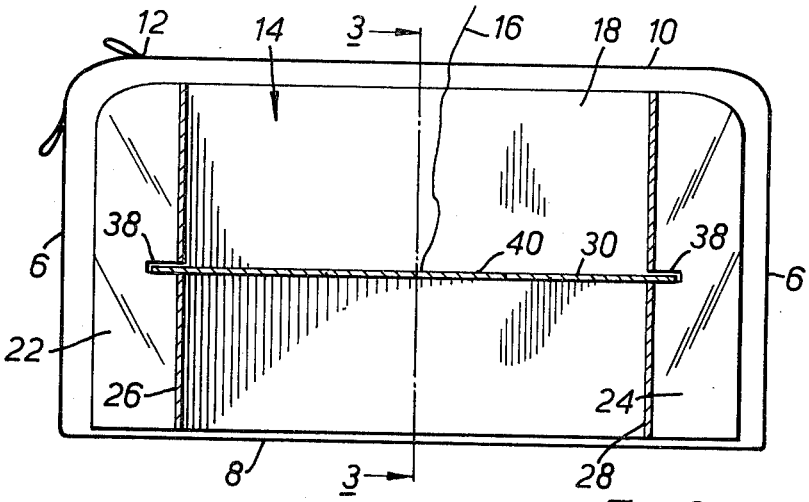
FIG. 2 is a longitudinal cross section through a bag and insert in the expanded condition of the bag.
Figure 3:
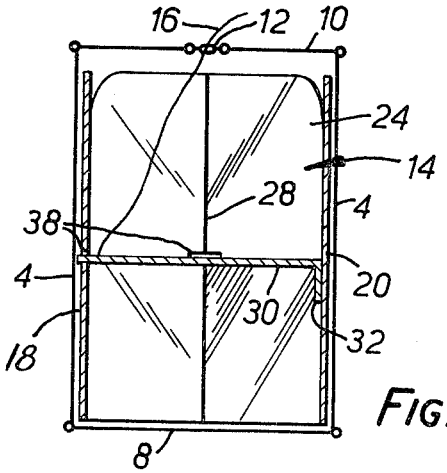
FIG. 3 is a cross-sectional view taken along the line 3—3 marked on FIG. 2.

FIG. 1 illustrates a collapsible bag 2 having side walls 4 end wall 6 bottom and top walls 8 and 10, and a slide fastener 12. In accordance with the invention, a collapsible insert 14 is located in the bag at the time of manufacture, the insert being provided with an operating string 16 which extends from the exterior of the bag. Initially the insert 14 is in a collapsed state and correspondingly the bag 2 is also in a collapsed state. Thus, the collapsed bag is in a compact position for storage and transport. At the point of sale, the string 16 is pulled and serves to expand the insert so that the bag assumes an expanded state, as seen in FIG. 1.

Details of the insert 14 will now be described with reference to FIGS. 2 to 6.

Figure 4:
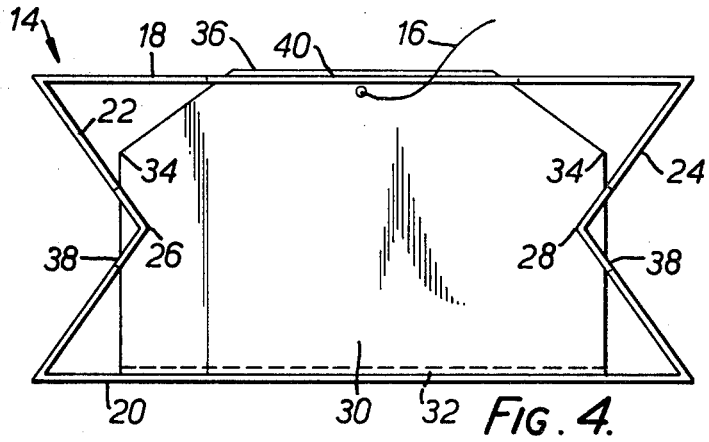
FIG. 4 is a plan view of the insert in its expanded condition.
Figure 5:
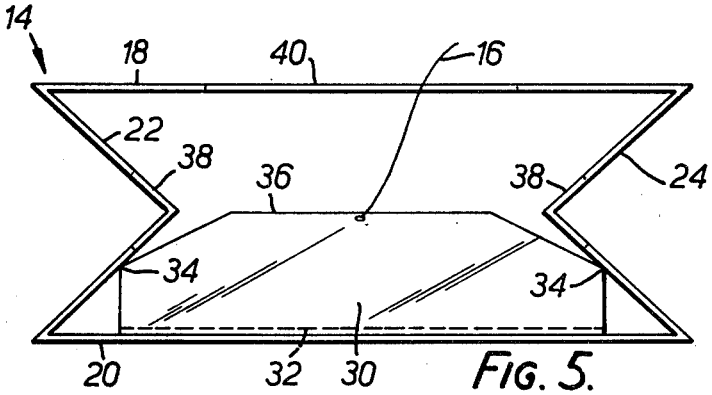
FIG. 5 is a plan view of the insert approaching its expanded condition.
Figure 6:
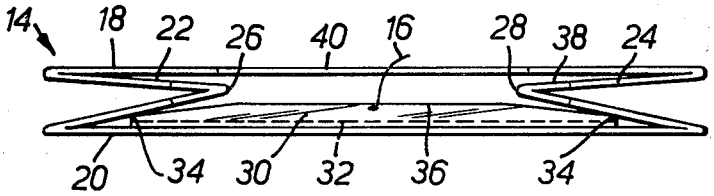
FIG. 6 is a plan view of the insert in its collapsed condition.

The insert 14 includes a pair of side plates 18 and 20 the size of which correspond generally to the side walls 4 of the bag 2. The side plates 18 and 20 are interconnected by end walls 22 and 24, each of which has a respective central fold line 26 and 28 which thereby permit the side plates 18 and 20 to be moved towards and away from one another with the end walls 22 and 24 being folded inwardly, as seen in FIGS. 4 to 6. The side plates 18 and 20 and end walls 22 and 24 can be made from a single strip of cardboard, the free ends of which being joined by adhesive tape or the like.

The insert includes a tongue 30 which is also formed from cardboard having a flange portion 32 affixed to the inner face of the side wall 20. As best seen in FIG. 4, the tongue is generally rectangular but has tapered forward side edges which thereby define shoulders 34 at the sides of the tongue and a leading free edge portion 36.

In the collapsed position of the insert 14, as seen in FIG. 6, the side walls 18 and 20 are relatively closely spaced and the tongue 30 lies generally parallel to the side plates 18 and 20 and generally between the side plate 20 and the fold lines 26 and 28 of the end walls 22 and 24. The natural resilience of the cardboard will tend to maintain the shoulders 34 of the tongue in contact with the end walls 22 and 24. In this condition, the insert is placed inside the bag 2 with the string 16, which is affixed near the leading edge 36, extending from the bag. When it is desired to expand the bag, the string 16 is pulled causing the tongue 30 to rotate about its point of connection to the side plate 20. The shoulders 34 of the tongue will engage the end walls 22 and 24 and cause these to move outwardly as seen in FIG. 5. On further movement of the tongue 30 the side edges of the tongue will engage the fold lines 26 and 28 of the end walls 22 and 24. When the tongue reaches a position where it is generally perpendicular to the side plates 18 and 20 the side edges of the tongue will enter slots 38 formed into the end walls 22 and 24. After the side edges have entered the slots 38, the fold lines 26 and 28 are permitted to move somewhat inwardly and thus the side plate 18 will be displaced inwardly towards the side plate 20. A slot 40 is provided in the side plate 18 so as to receive the leading portion 36 during this inward displacement and thus complete the interlocking of the plate 30 with the side plates 18 and 20 and end walls 22 and 24. In this condition, the side plates 18 and 20 are firmly held in an expanded condition whereupon the bag 2 is also held in its expanded condition.

Many modifications will be apparent to those skilled in the art. For instance, in the somewhat modified arrangement the free edge 36 may directly bear against the inner face of the side plate 18 to cause separation of the side plates 18 and 20. Further, the tongue need not lie perpendicular to the side plates 18 and 20 in the expanded condition of the insert 14.

The claims defining the invention are as follows:

1. A collapsible bag and an expandable bag insert located therein said insert comprising a pair of generally parallel plate members and a tongue, said tongue being rotatably mounted between the plate members for rotation between a first position wherein the tongue lies generally parallel to the plate members and a second position wherein the tongue is transverse to the plate members, and operating means accessable from the exterior of the bag which means are operable to cause movement of the tongue from its first to its second position thereby causing the tongue to separate said plate members and expand the bag.

2. A bag as claimed in claim 1 wherein the one edge of the tongue is hingedly connected to one of said plate members.

3. A bag as claimed in claim 2 wherein the operating means comprises a flexible line attached to the free end of the said tongue and extending from the exterior of the bag.

4. A bag as claimed in claim 1 wherein the two plate members are interconnected by folded end walls which deflect inwardly when the plate members are relatively closely spaced.

5. A bag as claimed in claim 4 wherein the end walls include slots which receive edge portions of the tongue when the latter is in its second position.

6. A bag as claimed in claim 4 wherein the side edges of the tongue engage said inwardly deflected end walls during movement from the first position to the second position and cause said end walls to move outwardly.

7. A bag as claimed in claim 6 wherein the side edges of the tongue are formed with shoulders which make first contact with the inwardly deflected end walls on movement of the tongue from the first position to the second position.

8. A bag as claimed in claim 2 wherein the other of said plate members includes a slot which receives the free end of the tongue when the latter is in its second position.

9. A bag as claimed in claim 1 wherein the tongue is generally perpendicular to the plate members when the tongue is in its second position.

* * * * *